US005735716A

United States Patent [19]

Bilezikjian

[11] Patent Number: 5,735,716

[45] Date of Patent: Apr. 7, 1998

[54] ELECTRICAL CONNECTORS WITH DELAYED INSERTION FORCE

[75] Inventor: John Peter Bilezikjian, Ypsilanti, Mich.

[73] Assignee: Yazaki Corporation, Tokyo, Japan

[21] Appl. No.: 715,404

[22] Filed: Sep. 18, 1996

[51] Int. Cl.[6] ..... H01R 13/11

[52] U.S. Cl. ..... 439/843

[58] Field of Search ..... 439/851, 843, 439/856, 263, 264, 857, 846

[56] References Cited

U.S. PATENT DOCUMENTS

| | | | |
|---|---|---|---|
| 3,123,429 | 3/1964 | Anderson et al. | 439/843 |
| 3,161,451 | 12/1964 | Neidecker | 439/946 |
| 4,530,553 | 7/1985 | Aujla | 339/17 LC |
| 4,588,240 | 5/1986 | Ruehl et al. | 439/851 |
| 4,657,335 | 4/1987 | Koch et al. | 339/256 R |
| 5,514,001 | 5/1996 | Szegda | 439/263 |

FOREIGN PATENT DOCUMENTS

| | | | |
|---|---|---|---|
| 0442639 | 8/1991 | European Pat. Off. | 439/851 |
| 0210500 | 8/1960 | Germany | 439/851 |
| 0579830 | 9/1976 | Switzerland | 439/851 |
| 1122094 | 7/1968 | United Kingdom | 439/851 |

*Primary Examiner*—Gary F. Paumen
*Assistant Examiner*—Tho Dac Ta
*Attorney, Agent, or Firm*—Young & Basile, P.C.

[57] ABSTRACT

An electrical connector wherein a female terminal has a deformable sleeve for receiving a male terminal in a manner such that the male terminal may be inserted almost fully into the interior of the sleeve before it contacts the sleeve and begins to meet any resistance to further insertion. Further urging of the male terminal into the sleeve causes the sleeve to deform both longitudinally and radially inward and apply pressure to the male terminal, thus producing sufficient normal force between the electrical contact surfaces of the sleeve and the male terminal to ensure good current flow therebetween. It is only over the last, relatively short distance of pin travel to the fully inserted position that any substantial resistance to insertion is encountered.

19 Claims, 3 Drawing Sheets

ELECTRICAL CONNECTORS WITH DELAYED INSERTION FORCE

BACKGROUND OF THE INVENTION

Electrical connectors, as the term is used herein, are components which are physically matable with one another, usually in pairs, in order to establish electrical continuity between various components of an electrical system. When two connectors are properly mated, electrically conductive terminal means included in each of the connectors are held in contact with one another to effect electrical contact, and the connectors often include some structure for latching, locking, or otherwise securing the connectors together in proper mating engagement. The efficiency with which electrical current may be transferred between mated electrical connectors depends upon, among other factors, the amount of contact surface area between the terminals and the magnitude of the normal force exerted over that contact surface area. A high normal force between connector terminals is particularly important for the efficient transfer of high levels of electric current.

One well-known type of electrical connector adapted for high-current applications has a male terminal in the form of a solid, cylindrical prong and a female terminal in the form of a plurality of spring-like wires or strips arrayed around the interior circumference of a tubular receptacle and extending between the opposite ends thereof. A connector of this type is disclosed in U.S. Pat. No. 4,657,335. The wires or strips bow slightly to the inside of the receptacle to define a minimum inside diameter smaller than the outside diameter of the prong so as to press radially inward against the outer surface of the prong when it is inserted axially into the receptacle. Physical contact between the prong and the strips, and thus resistance to insertion, occurs at the very beginning of the insertion stroke and continues throughout the stroke. The amount of force required to urge the prong into the receptacle increases along with the amount of contact surface area as the prong moves deeper into mating engagement with the receptacle. For a connector of this type designed to carry a high electric current, the amount of insertion force and the length of stroke over which it must be applied may combine to make it inconvenient or uncomfortable for a person to mate the connectors. Persons with physical limitations may find it difficult or impossible to mate such connectors.

SUMMARY OF THE INVENTION

It is an object of this invention to provide a pair of electrical connectors that are capable of effectively transferring a relatively high current when mated, yet may be mated by the application of a relatively small amount of force over a relatively short distance.

It is a further object of this invention to provide a pair of matable electrical connectors wherein resistance to insertion of one connector into the other is delayed until the insertion stroke is nearly completed.

In general, these objectives are achieved by a mating pair of electrical connectors wherein a female connector has a terminal in the form of a deformable sleeve for receiving a male terminal in a manner such that the male terminal may be inserted almost fully into the interior of the sleeve before it contacts the sleeve and begins to meet any resistance to further insertion. Further urging of the male terminal into the sleeve causes the sleeve to deform inwardly and apply pressure to the male terminal, thus producing sufficient normal force between the electrical contact surfaces of the sleeve and the male terminal to ensure good current flow therebetween. It is only over the last, relatively short distance of travel to the fully inserted position that any substantial resistance to insertion is encountered.

In the preferred embodiment of the invention depicted and described herein, the male terminal is a tapered pin having a flat distal end and a frustoconical lateral surface. The sleeve comprises a circular end surface and a plurality of generally parallel, circumferentially spaced spring arms extending from the outer edge of the end surface to define a deformable, longitudinal "cage" having an open end opposite the end surface. The sleeve is disposed within and attached to a tubular housing such that the ends of the spring arms adjacent the open end are restrained against both axial and radial movement relative to the housing. When the pin is inserted into the sleeve through the open end, it encounters little or no resistance until reaching an initial contact position wherein the distal end of the pin contacts the end surface. In this initial contact position clearance remains between the lateral pin surface and the spring arms. Urging of the pin deeper into the sleeve forces the end surface to move in the direction of insertion, away from the open end, and this movement causes the sleeve to deform in such a way as to elongate and constrict, drawing the spring arms inwardly and urging inner surfaces of the arms into contact with the lateral surfaces of the pin. When the pin has reached a fully inserted position within the female connector, latching means on the female connector and the pin interlock with one another to prevent the spring force of the sleeve from forcing the pin back out of the fully inserted position.

According to a feature of the invention, the spring arms are formed with inwardly bowed arch segments which deform to contact the pin when the pin is in the fully inserted position. The size and shape of the arches can be tailored to yield the required amounts of contact area and normal force between the sleeve and the pin as determined by the levels of current and voltage to be transmitted therebetween.

According to another feature of the invention, the arches of the spring arms have projections extending inwardly from their inner surfaces. The projections create a localized increase in the amount of normal force generated between the sleeve and the pin when the spring arms are urged into contact with the pin.

According to yet another feature of the invention, the latching means comprises a retaining ring encircling the open end of the sleeve and projecting inwardly so as to engage a notch formed in the pin when the pin is in the fully inserted position.

According to still another feature of the invention, the latching means alternatively comprises retaining means disposed adjacent the open end of the sleeve for engaging mating retaining means disposed adjacent the distal end of the male terminal when the male terminal is in the fully inserted position.

These and other objectives and features of the invention will become apparent upon examination of the following disclosure.

DETAILED DESCRIPTION OF THE PREFERRED EMBODIMENT

Figure 1:
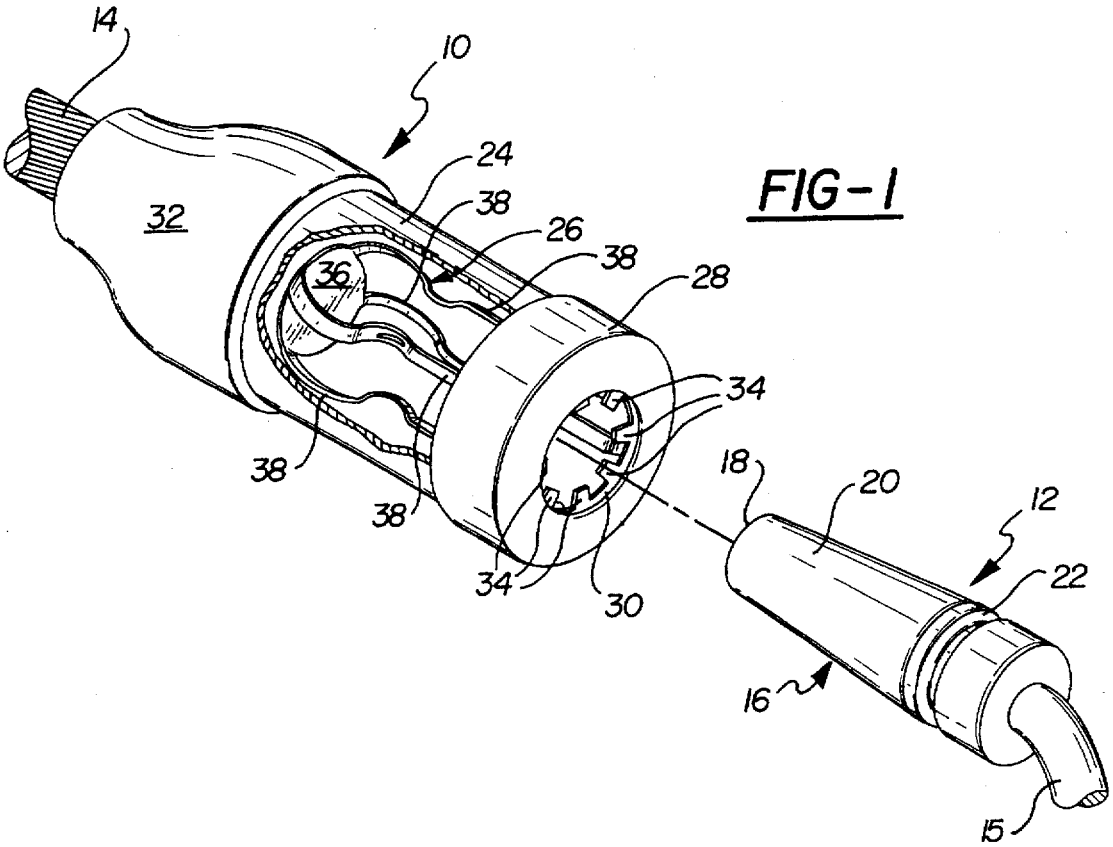
FIG. 1 is a perspective view of a male pin and a female receptacle according to the invention.

As seen in FIG. 1, the present invention comprises a female connector or receptacle 10 and a mating male connector 12, each of which is soldered, crimped, or otherwise joined to a respective wire or cable 14, 15. Male connector 12 comprises a terminal pin 16, and when the pin is fully inserted into receptacle 10 in the manner described hereinbelow, electrical contact is established between the two connectors to permit the flow of electrical current therethrough.

Pin 16 has a flat distal end 18 and a frustoconical lateral surface 20. A shallow notch 22 extends around the circumference of pin 16 adjacent the end at which cable 15 is attached.

Receptacle 10 comprises a tubular housing 24, a cage-like sleeve 26 positioned within the housing and retained therein by an annular collar 28 encircling a first end of the housing, and a retaining ring 30 trapped between the collar and the first end of the housing. An adapter 32 is attached to the opposite end of housing 24 and serves to connect cable 14 to receptacle 10. Retaining ring 30 has a plurality of resilient locking tabs 34 projecting radially inward to define an opening smaller than the outside diameter of pin 16.

Figure 2:
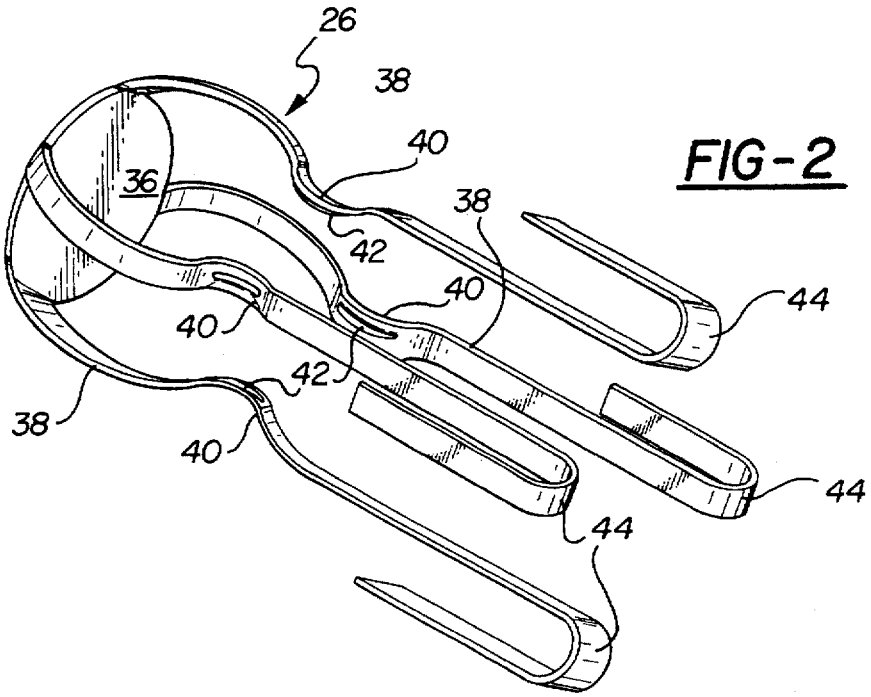
FIG. 2 is a perspective view of a sleeve as used in the receptacle of FIG. 1.

Referring to FIG. 2, sleeve 26 is an elongated, cage-like structure comprising a flat, circular end surface 36 and a plurality of narrow spring arms 38 extending generally perpendicularly therefrom at circumferentially spaced locations. Each spring arm 38 forms an S-curve immediately adjacent end surface 36, first bowing outwardly then back inwardly to define an inwardly convex arch 40. A projection 42 extends from the inward facing surface of each arch 40. An outwardly bent hook 44 is formed at the end of each spring arm 38 adjacent the open end of sleeve 26. Sleeve 26 is formed from a thin, resilient metal such that after being deformed within elastic limits from the configuration shown in FIG. 2 it will spring back to its original shape. Sleeve 26 may be fabricated by a conventional metal stamping process.

Although the depicted embodiment of the invention shows sleeve 26 as having four spring arms 38, the invention is not limited to that number but may have any number of spring arms necessary to achieve the required amount of contact surface area between the sleeve and pin 16.

Figure 3:
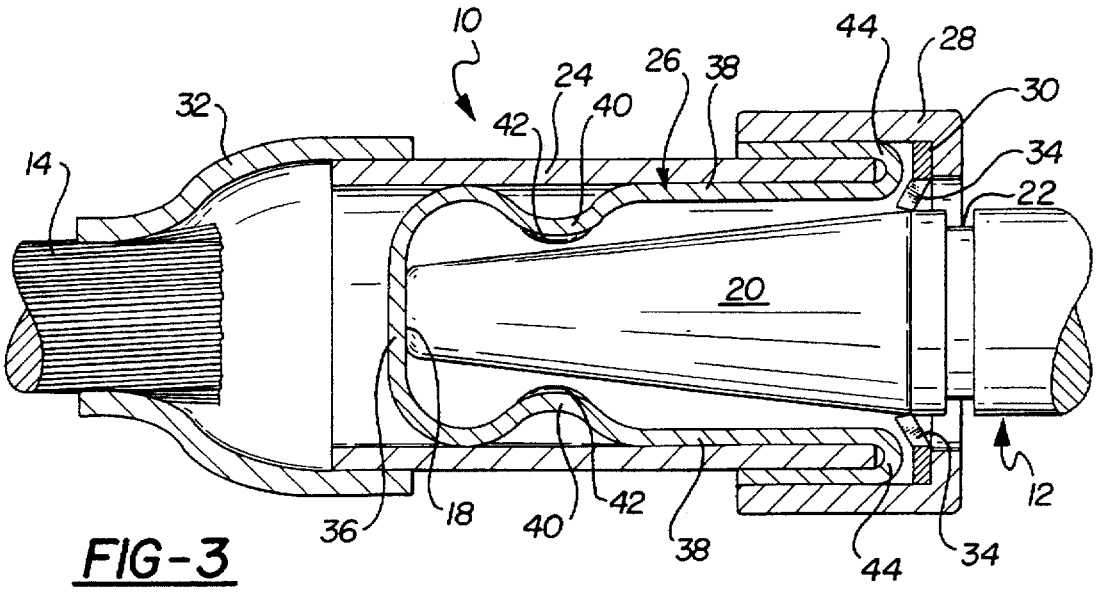
FIG. 3 is a cross-section of the connectors of FIG. 1 with the pin inserted into the receptacle to an initial contact position.

As best seen in FIG. 3, sleeve 26 is assembled with housing 24 such that spring arms 38 are inside the housing and generally parallel with the interior surface thereof, and hooks 44 wrap around the open end of the housing. Retaining ring 30 fits inside of collar 28, and the collar is pressed over hooks 44. A tight interference fit between the collar and the outside surfaces of hooks 44 retains the collar, housing 24 and sleeve 26 in secure engagement with one another and traps retaining ring 30 in coaxial alignment with the open end of the sleeve. Adapter 32 is secured over the opposite end of housing 24 by a press-fit or by soldering, and necks down to a diameter matching the gauge of cable 14.

Mating connection of male connector 12 and receptacle 10 is accomplished by aligning pin 16 with the opening defined by collar 28 and retaining ring 30, then inserting the pin fully into the receptacle. As pin 16 slides into receptacle 10, no resistance to insertion is encountered until the pin reaches the position relative to the receptacle depicted in FIG. 3 and referred to herein as the initial contact position. In the initial contact position, pin distal end 18 contacts end surface 36 and there is a small amount of radial clearance between the two components at all other locations. Pin 16 is substantially surrounded by sleeve 26 when in the initial contact position.

It is not strictly necessary that there be clearance between pin lateral surface 20 and spring arms 38 when in the initial contact position, as long as little or no resistance to insertion of the pin into receptacle 10 is encountered until pin 16 reaches the initial contact position. Sleeve 26 and pin 16 may be proportioned such that as pin 16 is inserted into receptacle 10, contact between the pin lateral surface 20 and spring arms 38 occurs simultaneously with contact between the distal end 18 and end surface 36.

Figure 4:
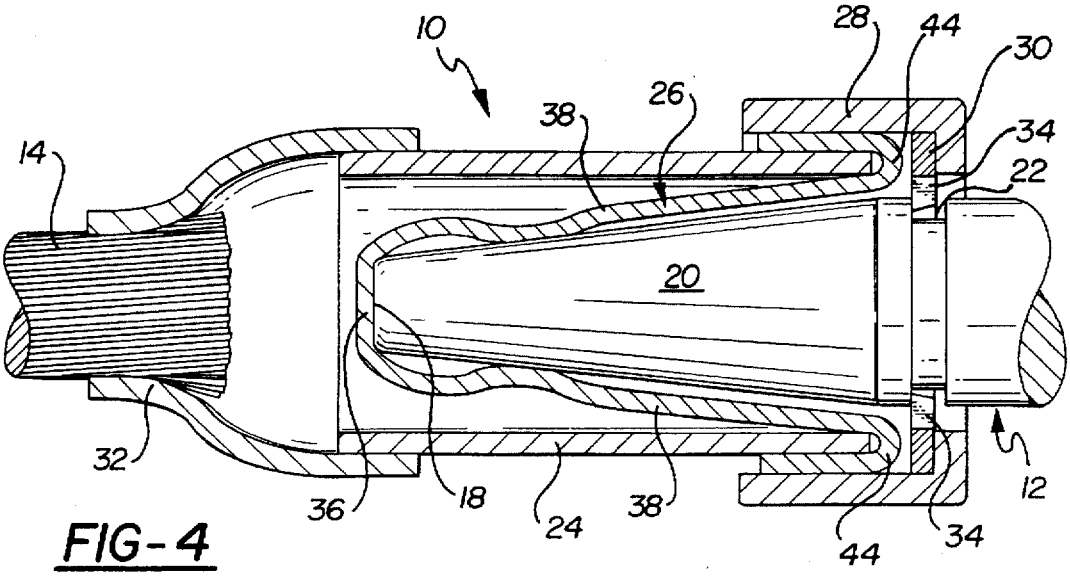
FIG. 4 is a cross-section of the connectors of FIG. 1 with the pin fully inserted into the receptacle and latched into engagement therewith.

To complete the mating engagement of the two connectors, an axial force is applied to pin 16, urging it into receptacle 10 beyond the initial contact position until it reaches the fully inserted position shown in FIG. 4. Urging of pin 16 to the fully inserted position causes sleeve 26 to deform both longitudinally and radially to the configuration shown in FIG. 4, wherein end surface 36 is displaced to the left due to pressure applied by pin distal end 18. This displacement of end surface 36 causes the entire sleeve to elongate and constrict, drawing spring arms 38 inwardly and urging the inner surfaces of arches 40 into contact with the lateral surface 20 of the pin.

Arches 40 flatten somewhat against lateral surface 20 as they are urged inwardly, producing an elongated area of contact between each spring arm and the pin and thus improving the quality of the electrical contact. Projections 42 extend radially inwardly from arches 40 and so are urged most strongly against pin 16, thus creating localized zones of increased normal force between the two terminals to further enhance electrical contact. The precise geometry of spring arms 38, arches 40 and projections 42 can be tailored to yield the required amounts of contact area and normal force between sleeve 26 and pin 16 as determined by the levels of current and voltage to be transmitted therebetween.

As pin 16 moves past the initial contact position to the fully inserted position, the pin comes into contact with locking tabs 34, and the tabs are flexible enough for this contact to cause the tabs to deflect toward end surface 36 slightly. When pin 16 reaches the fully inserted position within receptacle 10, locking tabs 34 snap back to their undeflected configuration and into engagement with notch 22. This engagement prevents the spring force exerted on pin 16 by sleeve 26 from forcing the pin back out of receptacle 10 and so effectively latches the connectors together.

To withdraw pin 16 from receptacle 10, it is only necessary to apply sufficient force to the pin to deflect tabs 34 sufficiently to disengage them from notch 22. After this occurs there is no resistance to withdrawal of pin 16 from receptacle 10, and in fact the pin is pushed outwardly by the spring action of sleeve 26 as it returns to its undeformed configuration.

As is apparent from comparing FIGS. 3 and 4, pin 16 moves only a relatively short distance in the longitudinal direction when it is urged from the initial contact position to the fully inserted position. Since no resistance to insertion is offered by receptacle 10 until pin 16 is urged beyond the initial contact position, it is only over this relatively short portion of the insertion stroke that any substantial insertion force needs to be applied to the pin.

Figure 5:
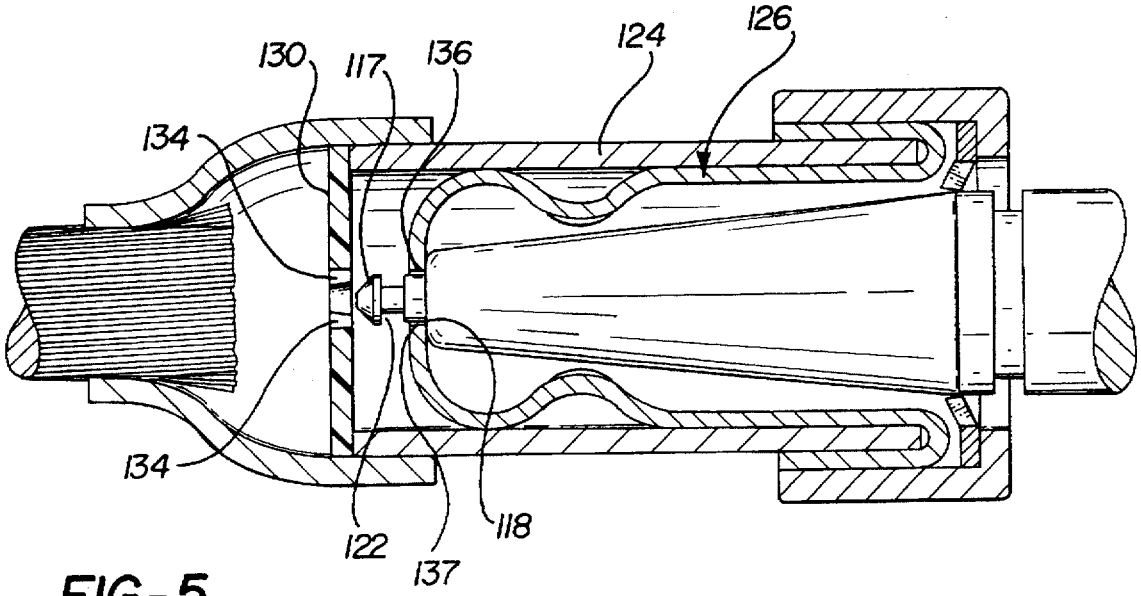
FIG. 5 is a cross-section of an alternative embodiment of the invention having latching means located adjacent the closed end of the sleeve and at the distal end of the pin.

An alternative means for latching the invention male and female connectors together is shown in FIG. 5. In this embodiment, a sleeve 126 has an end surface 136 with a central hole 137 formed therein, and a pin 116 has an probe 117 projecting from a distal end 118. A retaining ring 130 is located adjacent the end of housing 124 in a position such that when pin 116 is urged beyond the initial contact position shown in FIG. 5 to a fully inserted position, locking tabs 134 of retaining ring 130 snap into engagement with a notch 122 in probe 117. Any number of alternative latching mechanisms are useable to maintain connectors according to the present invention in fully mated contact.

It will be appreciated that the drawings and descriptions contained herein are merely meant to illustrate a particular embodiment of the present invention and are not meant to be limitations upon the practice thereof, as numerous variations will occur to persons of skill in the art. For example, although the invention is described above in relation to pair of connectors having only a single terminal, it is to be understood that the invention may also be practiced in relation to a multi-terminal connector. In such a multi-terminal connector, pin 16 is constructed to have two or more terminals disposed around the circumference of lateral surface 20 and electrically isolated from one another, and spring arms 38 are separate terminals which make contact with the respective terminals on the pin when the connectors are mated. If it is necessary to ensure a specific one-to-one correspondence between the mated terminals, aligning means may be provided on the connectors to allow pin 16 and sleeve 26 to be mated only in the angular orientation relative to one another which provides the proper terminal alignment. This may be accomplished, for example, by providing a longitudinally oriented keyway on one connector which receives a key on the mating connector only when the connectors are properly aligned.

What is claimed is:

1. A female electrical terminal for mating engagement with a male terminal having a distal end and lateral surfaces, the female terminal comprising:

a conductive sleeve having a displaceable end surface disposed at a first, closed end of the sleeve and a plurality of spring arms extending from the end surface toward a second, open end of the sleeve, the sleeve having a first configuration wherein inner surfaces of the spring arms are spaced from one another by an amount sufficient to permit the male terminal to be inserted through the open end of the sleeve to an initial contact position wherein the distal end of the male terminal contacts the end surface and the spring arms substantially surround the male terminal without the inner surfaces of the spring arms applying substantial pressure on the lateral surfaces of the male terminal, and the sleeve being deformable to a second configuration by urging the male terminal into the sleeve beyond the initial contact position to a fully inserted position wherein the end surface is displaced away from the open end of the sleeve and the spring arms are urged inwardly to apply pressure on the lateral surfaces of the male terminal.

2. A female terminal according to claim 1 for mating with a male terminal which is generally circular in cross section, the spring arms being spaced around the circumference of the male terminal when the male terminal is in the initial contact position, and the spring arms being urgeable radially inward when the sleeve is deformed from the first configuration to the second configuration.

3. A female terminal according to claim 1 wherein the end surface and the spring arms are formed integrally from a piece of sheet metal.

4. A female terminal according to claim 1 wherein at least one of the spring arms comprises an inwardly convex arch for contacting the male terminal.

5. A female terminal according to claim 4 wherein the inwardly convex arch has a projection extending inwardly therefrom for contacting the male terminal.

6. A female terminal according to claim 1 further including latching means for maintaining the male terminal in the fully inserted position.

7. A female terminal according to claim 6 wherein the latching means is disposed adjacent the end surface of the sleeve and is engagable with second latching means disposed on the male terminal adjacent the distal end thereof.

8. A female terminal according to claim 6 wherein the latching means comprises a retaining ring encircling the sleeve for engagement with a notch in the male terminal when the male terminal is in the fully inserted position.

9. A female terminal according to claim 8 wherein the retaining ring is disposed adjacent the open end of the sleeve.

10. An electrical connector comprising complemental male and female terminals, the female terminal comprising:

an elongate, electrically conductive sleeve having a first end and an open second end for receiving the male terminal substantially between the ends in radially spaced relation with the sleeve, the first end having an end surface for contacting the male terminal when the male terminal is inserted into the sleeve to an initial contact position and displaceable away from the open end by the male terminal as the male terminal is inserted to a fully inserted position, the sleeve further comprising means connected to the end surface and extending between the end surface and the second end of the sleeve for elastically deforming longitudinally and radially inward as the end surface is displaced to close onto the male terminal as the male terminal is inserted into the sleeve beyond the initial contact position to the fully inserted position.

11. An electrical connector according to claim 10 wherein the male terminal has a distal end and a lateral surface, and wherein:

the end surface of the sleeve is contactable by the distal end of the male terminal when the male terminal is in the initial contact position; and the means for elastically deforming is a plurality of spring arms extending generally in the longitudinal direction from the end surface and spaced from one another to substantially surround the male terminal, the spring arms having inner surfaces for contacting and applying pressure on the lateral surfaces of the male terminal when the male terminal is in the fully inserted position.

12. An electrical connector according to claim 11 wherein the male terminal is generally circular in cross section, the spring arms are spaced around a circumference of the male terminal when the male terminal is in the initial contact position, and the spring arms deform radially inward when the sleeve is deformed as the male terminal is inserted to the fully inserted position.

13. An electrical connector according to claim 11 wherein the end surface and the spring arms are formed integrally from a piece of sheet metal.

14. An electrical connector according to claim 11 wherein at least one of the spring arms comprises an inwardly convex arch for contacting the male terminal.

15. An electrical connector according to claim 14 wherein the inwardly convex arch has a projection extending inwardly therefrom for contacting the male terminal.

16. An electrical connector according to claim 11 further including latching means for maintaining the male terminal in the fully inserted position.

17. An electrical connector according to claim 16 wherein the latching means comprises first latching means disposed on the female terminal adjacent the end surface of the sleeve and second latching means engagable with the first latching means disposed on the male terminal adjacent the distal end of the male terminal.

18. An electrical connector according to claim 16 wherein the latching means comprises a retaining ring encircling the sleeve and a notch in the male terminal, the retaining ring engagable with the notch when the male terminal is in the fully inserted position.

19. An electrical connector according to claim 18 wherein the sleeve has an open end opposite the end surface and the retaining ring is disposed adjacent the open end of the sleeve.

* * * * *